United States Patent [19]

Menchetti

[11] Patent Number: 4,796,396

[45] Date of Patent: Jan. 10, 1989

[54] INTEGRAL WALLBOARD AND STUD

[75] Inventor: Robert J. Menchetti, Buffalo, N.Y.

[73] Assignee: National Gypsum Company, Dallas, Tex.

[21] Appl. No.: 83,488

[22] Filed: Aug. 10, 1987

[51] Int. Cl.[4] ..... E04B 2/30

[52] U.S. Cl. ..... 52/127.5; 52/481; 52/508; 52/241

[58] Field of Search ..... 52/407, 511, 481, 508, 52/509, 241, 127.5, 127.6, 741

[56] References Cited

U.S. PATENT DOCUMENTS

| | | | |
|---|---|---|---|
| 2,160,845 | 6/1939 | Eason | 52/420 |
| 2,597,309 | 5/1952 | Finck | 52/406 |
| 3,112,532 | 12/1963 | Slowinski . | |
| 3,165,791 | 1/1965 | Valsvik | 52/407 |
| 3,188,773 | 6/1965 | Schneller . | |
| 3,564,785 | 2/1971 | Kephart | 52/238.1 |
| 3,608,266 | 9/1971 | Satkin | 52/511 |
| 3,816,199 | 6/1974 | Dawdy | 52/483 |
| 3,866,376 | 2/1975 | Nelsson | 52/762 |
| 3,965,939 | 6/1976 | Boarini | 52/483 |
| 4,679,370 | 7/1987 | Samuelson . | |

*Primary Examiner*—John E. Murtagh

*Attorney, Agent, or Firm*—Laird F. Miller; Robert F. Hause

[57] ABSTRACT

A wallboard and stud unit formed of an elongate strip of foldable steel affixed to the wallboard back face, adapted to be folded outwardly away from the wallboard to function as a wall stud, in a hollow wall having a plurality of such units in back-to-back relationship.

7 Claims, 2 Drawing Sheets

INTEGRAL WALLBOARD AND STUD

BACKGROUND OF THE INVENTION

This invention relates to a novel wallboard and stud combination particularly adapted for compact storage and shipment and for easy transformation into perpendicularly disposed wallboard and stud elements for use in constructing interior walls and partitions.

Prior wall constructions have included combinations including gypsum board facing elements with elements which are foldably affixed for compact storage and shipment, to be unfolded to a perpendicular disposition to function as the wall supporting studs. U.S. Pat. No. 3,112,532 discloses a wall panel of two parallel wallboards with a foldable cardboard core, of corrugated configuration, foldable from a flat compact condition in which all elements are in substantially parallel planes, to an open condition in which the cardboard ribs are perpendicular to the wallboards, forming a hollow panel. U.S. Pat. No. 3,188,773 discloses a gypsum wallboard which has been cut into a plurality of alernating wide and narrow sections, which are foldable from a flat compact condition in which all elements are in substantially parallel planes, to an open condition in which the narrow sections are perpendicular to the wide sections, forming a hollow panel.

SUMMARY OF THE INVENTION

The present invention is directed to a combination of gypsum wallboard with an attached foldable sheet metal stud element which is adhered along the edge of the wallboard. The sheet metal foldable stud is of a continuous elongate form having a narrow elongate inner edge portion firmly adhered to the wallboard back face, inward from, but parallel to and near the wallboard side edge, a relatively wider elongate central web portion definitely not adhered to the wallboard, foldable from a position extending out over the wallboard side edge to a position perpendicular to the wallboard back face, and a third narrow elongate outer edge flange portion, extending perpendicular to the web portion, in a direction from the web portion opposite to the direction the inner edge portion extends when the web is folded perpendicular to the wallboard.

It is an object of the invention to provide an improved structure for forming both wallboard and stud, in a wall construction.

It is a further object to provide a novel foldable steel sheet for compact placement for storage and shipment and foldable to provide a strong, rigid wall stud, when adhered to a wallboard.

It is a still further object to provide a novel hollow wall having a metal stud factory affixed to a wallboard.

BRIEF DESCRIPTION OF THE DRAWINGS

These and other objects and advantages will be more readily apparent when considered in relation to the preferred embodiments of the invention as set forth in the specification and shown in the drawings in which.

DESCRIPTION OF THE PREFERRED EMBODIMENTS

Figure 1:
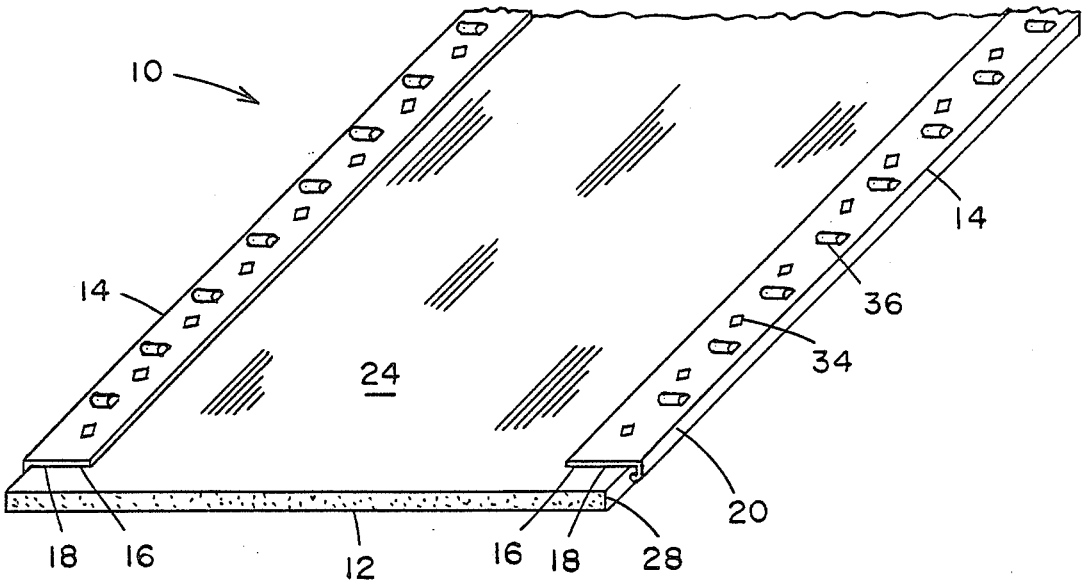
FIG. 1 is an isometric end view of a sheet of gypsum wallboard with a foldable sheet metal stud element affixed along each side edge of the wallboard, in accordance with the invention.
Figure 2:
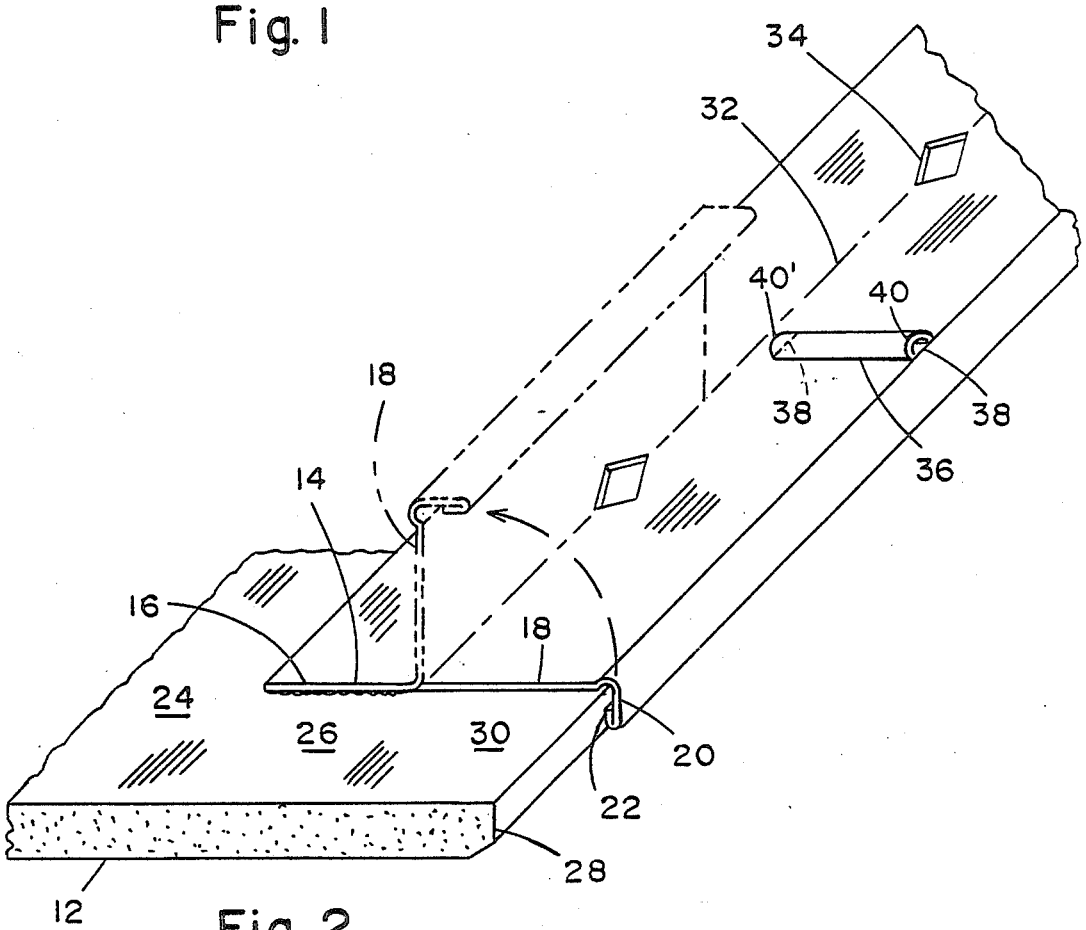
FIG. 2 is an enlarged isometric end view of one corner of the wallboard of FIG. 1, with the metal stud element shown in phantom in a folded out disposition, for use as a wall stud.

Referring to FIGS. 1 and 2, there is shown a factory laminated wallboard and stud wall unit 10, consisting of a paper covered bevelled edge gypsum wallboard 12 adhesively affixed to two roll-formed sheet metal stud elements 14, 14, which extend almost the full length of the wallboard 12.

Each stud element 14 is an elongate strip of .015 inch thick steel which includes an attachment portion 16 of about two inch width along the inner edge of the stud element 14, a web portion 18 of about two-and-a-half inch width adjoined to and coplanar with the attachment portion 16, and a downwardly extending flange portion 20 adjoined to and perpendicular to the web portion 18. Flange portion 20 preferably also includes a reversely bent upwardly extending edge portion 22.

The attachment portion 16 is the only part of stud element 14 that is adhesively affixed to the back face 24 of the wallboard 12, and is affixed along a strip 26 on the back face 24, which is spaced inwardly from the side edge 28 of the wallboard 12, a distance of almost two-and-a-half inches, whereby web portion 18 lies against the edge portion 30 of back face 24 and flange portion 20 extends downwardly closely adjacent wallboard side edge 28. The width of flange portion 20 is equal to or slightly less than the thickness of wallboard 12, which is preferably between about $\frac{3}{8}$ to $\frac{5}{8}$ inch.

A fold line 32 is formed along the junction of the attachment portion 16 and web portion 18, preferably in the form of a slight elongate depression in the metal and preferably a plurality of small diamond shaped holes 34 are located along fold line 32, spaced apart about every two to six inches.

Slightly raised reinforcing ribs 36 extend perpendicular to the fold line 32 in the web portion 18, spaced evenly apart about every four to twelve inches. Ribs 36 can be formed with a slit 38 through the sheet metal at both ends 40, 40', leaving an opening completely through ribs 36 for a reason to be discussed below. Alternatively, the slits 38 can be eliminated and a triangular or diamond shaped hole, such as holes 34, can be formed along the fold line 32, at the one end of each rib 36.

FIG. 2 shows how the stud element is folded from a flat original storage form to a right-angled Z-shaped functional form, in phantom lines.

Figure 4:
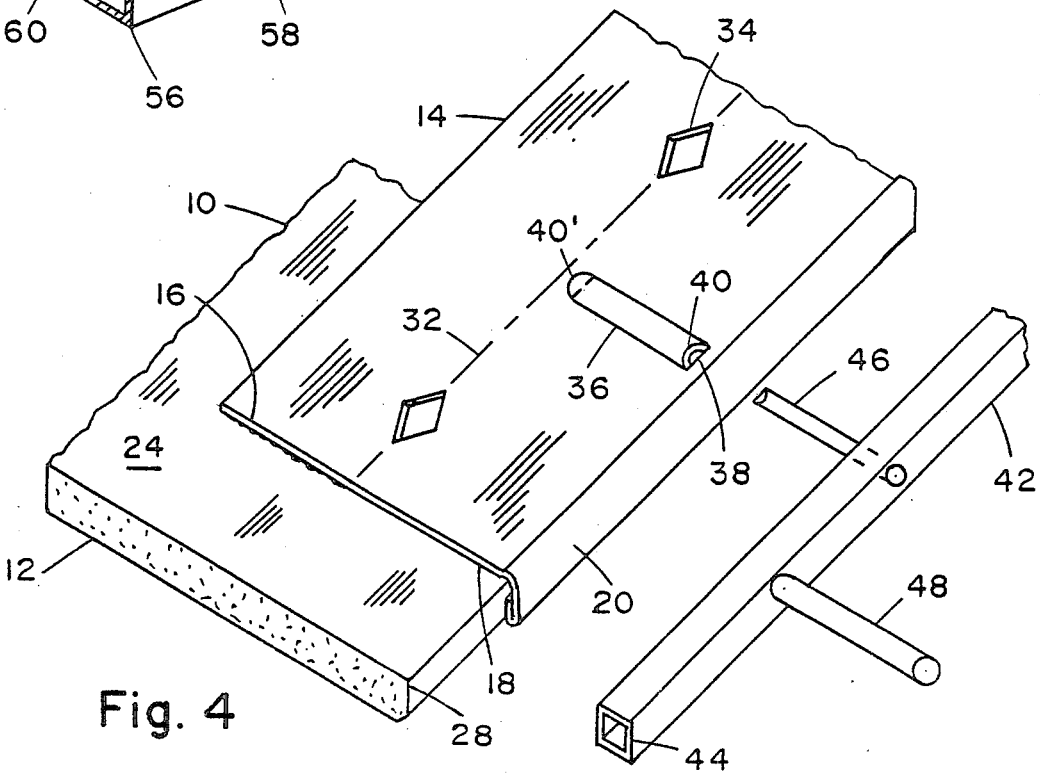
FIG. 4 is a view similar to FIG. 2 further including a stud element bending tool, in accordance with the invention.

FIG. 4 shows a novel tool 42 for folding the stud element 14 to its functional form. The tool 42 includes a rigid elongate body 44, which has a length approximately the length of the longest units 10 available, which will be about eight to twelve feet. Projecting forwardly from body 44 are a plurality of pegs 46, spaced evenly apart about every four to twelve inches, depending on the spacing of ribs 36. Pegs 46 have a length and diameter suitable for firmly fitting through the ribs 36 and extending slightly out of the remote end 40', terminating at or short of fold line 32. At least one handle 48 extends rearwardly from body 44, preferably two or more, for raising the web portion 18 in a folding motion around fold line 32.

Figure 3:
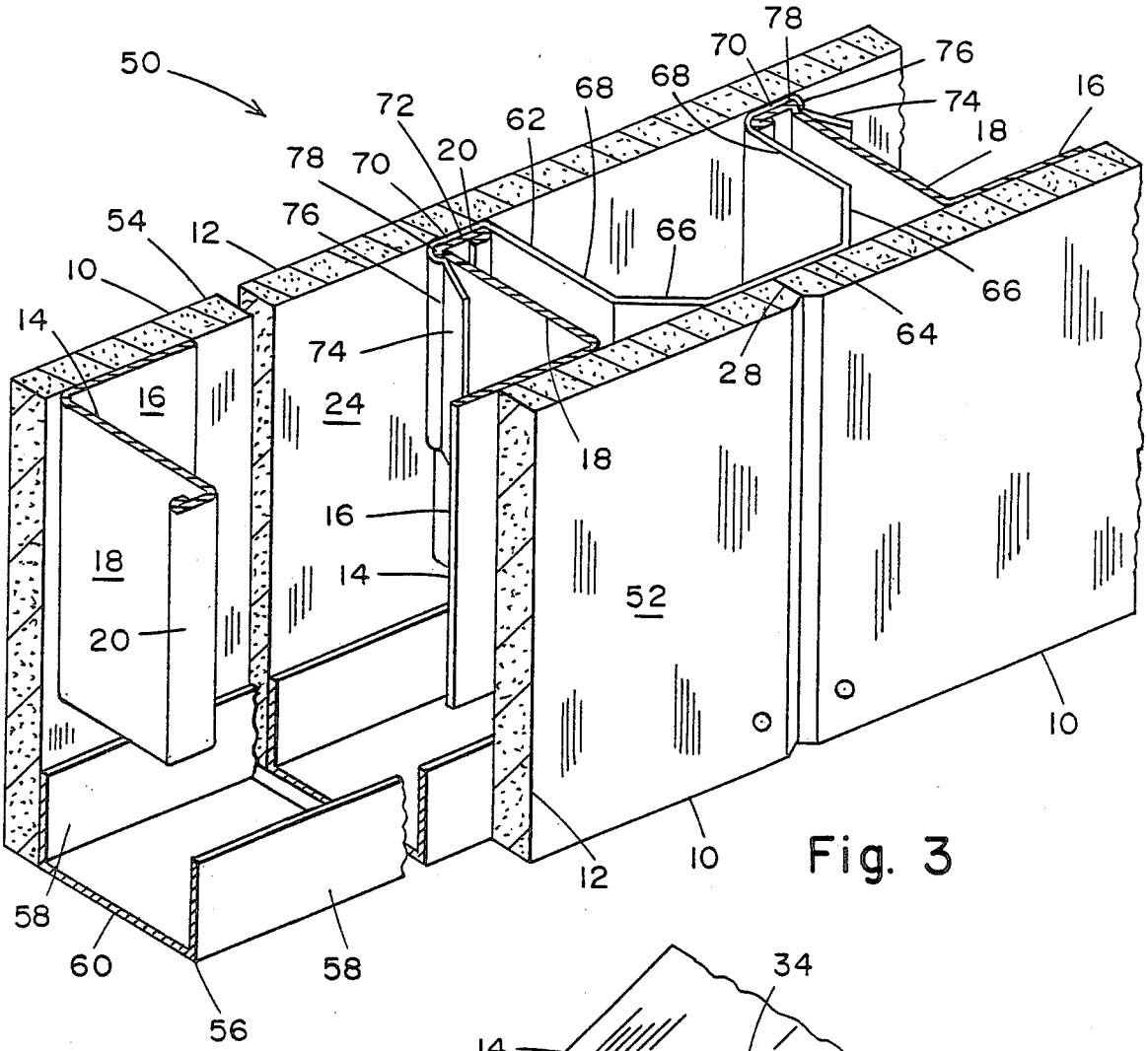
FIG. 3 is an isometric sectional plan view of a hollow partition wall constructed of the wallboards with stud elements of FIG. 2.

FIG. 3 shows a hollow wall 50 formed of a plurality of units 10. With the web portion 18 and flange portion 20 on each of the two stud elements 14 on the two side edges 28, 28 of each unit 10 in the functional form, the stud elements 14 each provide the normal functions of prior wall studs, holding the wallboard in place and providing suitable rigidity to the wall.

In forming the wall 50, one set of wallboard and stud units 10 is arranged with wallboard edges 28 abutting one another to form a front side 52 of wall 50, with stud web portions 18 projection rearwardly. A second set of units 10 is arranged, also with their wallboard edges abutting one another (not shown, since portions of only one wallboard of the second set are shown), forming a rear side 54 of wall 50, with their stud web portions 18 projecting forwardly. The wall 50 is constructed by placing one unit 10 against the outside of a floor track 56 and the outside of a ceiling track (not shown), and the two ends of the wallboard 12 are screwed to a flange 58 of floor track 56 and a flange of the ceiling track (not shown). Each end of each stud element 14 is enough short of the end of the wallboard 12 to allow room for the wallboard ends to extend down along the outside of the track flanges. The web 60 of the floor track 56 and the web of the ceiling track (not shown) are both equal in width to the width of the web portion 18 of each stud element 14.

A plurality of additional wall units 10 can then be affixed to the floor and ceiling tracks, on the same side, with the same procedure. Subsequently, a plurality of similar wall units 10 are mounted on the opposite side of the floor and ceiling tracks and screwed to the flange 58 of floor track 56 and an opposite flange of the ceiling track (not shown). Because the floor track and ceiling track webs are equal in width to the width of the web portions 18 of the stud elements 14, the flange portions 20 of each unit 10 abut the back face 24 of wallboard on the opposite side of wall 50.

In the embodiment shown in FIG. 3, the adjacent units 10 on each respective side of wall 50 are also adjoined one to another by the use of preferred, but optional, clips 62. Clips 62 are narrow, prefolded strips of spring steel having a central web 64 disposed firmly against the back of the wallboard edges 28, bridging the edges 28 of the two abutting wallboards 12, maintaining the abutting wallboards in coplanar relationship. Angled upwardly and outwardly from each side of web 64 is a short angled leg 66, followed by a perpendicular leg 68. At the outer end of each perpendicular leg 68 and extending perpendicularly outwardly therefrom, is an opposite side web 70, disposed against the outer face 72 of a flange portion 20.

Each opposite side web 70 is slightly wider than the width of a flange portion 20, and has along its opposite edge a hook-type flange 74 extending downwardly around the remote side web portion 18. An inwardly depressed hump 76 on flange 74 engages an outwardly depressed hump 78 on web portion 18, locking the two together. With one such interlocking of humps 76 and 78 on each of the two adjacent stud elements, the clip 62 tends to hold the two abutting side edges 28, 28 in tight abutment.

The wallboard side edge 28 is shown to have a bevelled edge, however, tapered edge board, for use with a joint concealing drywall treatment, or square edge board may also be used in accordance with the invention. With the bevelled edge board or the square edge board, a decorative vinyl film or cloth facing may be used on the board face and side edges. One reason for providing a small space between the side edge 28 of the board and the flange portion 20 of the clip is to permit the use of a subsequently added film of decorative vinyl or cloth on the wallboard face and side edges.

Having completed a detailed disclosure of the preferred embodiments of my invention, so that others may practice the same, I contemplate that variations may be made without departing from the essence of the invention.

I claim:

1. A wallboard and stud unit comprising a wallboard and an elongate sheet metal strip affixed to the back face of said wallboard, said metal strip having an elongate attachment portion affixed to said wallboard, said metal strip also having an elongate web portion which is formed and suitably disposed for bending, along an elongate fold line parallel to an edge of said wallboard, from a storage form, in which said attachment portion and said web portion are substantially coplanar, to a functional form, in which said web portion extends substantially perpendicularly to said wallboard back face and to said attachment portion, wherein said metal strip further includes a flange portion extending perpendicularly from the outer edge of said web portion and wherein said flange portion is disposed along and closely spaced from the side edge of said wallboard, when said web portion is in a storage form, and said flange portion is substantially equal in width to the thickness of said wallboard.

2. A wallboard and stud unit comprising a wallboard and an elongate sheet metal strip affixed to the back face of said wallboard, said metal strip having an elongate attachment portion affixed to said wallboard, said metal strip also having an elongate web portion which is formed and suitably disposed for bending, along an elongate fold line parallel to an edge of said wallboard, from a storage form, in which said attachment portion and said web portion are substantially coplanar, to a functional form, in which said web portion extends substantially perpendicularly to said wallboard back face and to said attachment portion, wherein slightly raised reinforcing ribs extend perpendicular to said fold line, in said web portion, spaced evenly apart at about every four to twelve inches and wherein said raised ribs have openings at each end suitable for reception of a bending tool.

3. A hollow wall comprising a plurality of wallboard and stud units comprising a wallboard and elongate sheet metal strips affixed to the back face of said wallboard adjacent to each side edge of said wallboard, said metal strips each having a continuous elongate attachment portion affixed to said wallboard, said metal strips each also having a continuous elongate web portion which has been bent, along an elongate fold line parallel to an edge of said wallboard, from a storage form, in which said attachment portion and said web portion are substantially coplanar and include an elongate flange portion extending perpendicularly from the web outer edge closely spaced from and substantially equal in width to said side edge of said wallboard, to a functional form, in which said web portion extends substantially perpendicularly to said wallboard back face and to said attachment portion, wherein said wallboards of some of said units are positioned vertically to form one side of a hollow wall and said wallboards of others of said units are positioned vertically to form a spaced parallel opposite side of said wall, said web elements being disposed in a functional form extending substantially perpendicular to said wallboard back face, said web portion providing rigidity to the wallboards of said wall.

4. A hollow wall as defined in claim 3 wherein said flange portions of one unit are located abutting the back face of a wallboard on the side of the wall opposite said unit.

5. A hollow wall as defined in claim 3 wherein a metal clip is attached to the flange portions of adjacent units, holding the wallboards in closely edge-abutting relationship.

6. A hollow wall as defined in claim 5 wherein said clip has a central web disposed behind the edges of said abutting wallboards maintaining said wallboards in coplanar relationship.

7. A hollow wall as defined in claim 6 wherein said metal strip web portion has a small hump adjacent said metal strip flange portion and said clip has a small hump engaging said web portion hump, holding said wallboard and stud units in close abutment.

* * * * *